US009919889B2

(12) United States Patent
Nakatsu et al.

(10) Patent No.: US 9,919,889 B2
(45) Date of Patent: Mar. 20, 2018

(54) SHEET GUIDE DEVICE AND PRINTER

(71) Applicant: Seiko Epson Corporation, Tokyo (JP)

(72) Inventors: Masashi Nakatsu, Azumino (JP); Daisuke Yanagimachi, Matsumoto (JP); Norio Nagata, Matsumoto (JP); Kenichi Hirabayashi, Shioriji (JP)

(73) Assignee: SEIKO EPSON CORPORATION, Tokyo (JP)

( * ) Notice: Subject to any disclaimer, the term of this patent is extended or adjusted under 35 U.S.C. 154(b) by 75 days.

(21) Appl. No.: 14/906,215

(22) PCT Filed: Jul. 16, 2014

(86) PCT No.: PCT/JP2014/003781
§ 371 (c)(1),
(2) Date: Jan. 19, 2016

(87) PCT Pub. No.: WO2015/008488
PCT Pub. Date: Jan. 22, 2015

(65) Prior Publication Data

US 2016/0159601 A1 Jun. 9, 2016

(30) Foreign Application Priority Data

Jul. 19, 2013 (JP) ..... 2013-150965

(51) Int. Cl.
*B41J 15/00* (2006.01)
*B65H 23/02* (2006.01)
*B65H 35/04* (2006.01)

(52) U.S. Cl.
CPC ..... *B65H 23/02* (2013.01); *B65H 35/04* (2013.01); *B65H 2701/192* (2013.01); *B65H 2701/194* (2013.01)

(58) Field of Classification Search
CPC ..... B65H 23/02
(Continued)

(56) References Cited

U.S. PATENT DOCUMENTS 4,214,691 A * 7/1980 van Namen ..... B41J 11/32 226/100
4,391,399 A * 7/1983 Seitz ..... B41J 11/30 226/74
(Continued)

FOREIGN PATENT DOCUMENTS

JP 58-016969 Y 2/1983
JP 06-064805 A 3/1994
(Continued)

OTHER PUBLICATIONS

International Search Report dated Oct. 7, 2014, for Application No. PCT/JP2014/003781.

*Primary Examiner* — Anthony Nguyen
(74) *Attorney, Agent, or Firm* — Nutter McClennen & Fish LLP; John J. Penny, Jr.

(57) ABSTRACT

A sheet guide device has a crumpling prevention unit disposed to a movable part with a guide surface that guides a side edge of die-cut label paper conveyed over the top of a feed plate, and prevents crumpling the side portion of the die-cut label paper of which the side edge contacts the guide surface. The crumpling prevention unit includes a pressure-bearing base unit disposed protruding from the top of the feed plate and causing the side portion of the passing die-cut label paper to rise to the side; a sheet presser part that presses the die-cut label paper to the conveyance path surface at the same or adjacent position to the pressure-bearing base unit; and a side presser member that the side edge of the die-cut label paper inclined by the pressure-bearing base unit contacts.

7 Claims, 11 Drawing Sheets

(58) Field of Classification Search
USPC ..... 400/619
See application file for complete search history.

(56) References Cited

U.S. PATENT DOCUMENTS

| | | | | |
|---|---|---|---|---|
| 5,279,454 | A | 1/1994 | Morse et al. | |
| 6,176,411 | B1 * | 1/2001 | Suketomo | B65H 20/20 226/195 |
| 6,447,185 | B1 * | 9/2002 | Kashiwaba | B65C 9/1892 101/288 |
| 8,016,224 | B2 * | 9/2011 | Bandholz | B65H 23/0208 226/196.1 |
| 8,882,374 | B2 * | 11/2014 | Colonel | B41J 3/4075 242/596 |
| 2009/0097897 | A1 * | 4/2009 | Kim | B41J 13/103 400/642 |
| 2010/0026738 | A1 | 2/2010 | Saikawa et al. | |
| 2012/0013692 | A1 * | 1/2012 | Innes | B41J 13/076 347/102 |
| 2012/0098190 | A1 | 4/2012 | Nieda et al. | |
| 2012/0242037 | A1 | 9/2012 | Nieda et al. | |
| 2013/0140768 | A1 | 6/2013 | Nieda et al. | |
| 2014/0167344 | A1 | 6/2014 | Saikawa et al. | |

FOREIGN PATENT DOCUMENTS

| | | | |
|---|---|---|---|
| JP | 09-086684 | A | 3/1997 |
| JP | 11-314414 | A | 11/1999 |
| JP | 2000-355132 | A | 12/2000 |
| JP | 2010-030183 | A | 2/2010 |
| JP | 2012-086976 | A | 5/2012 |

* cited by examiner

SHEET GUIDE DEVICE AND PRINTER

Priority is claimed under 35 U.S.C. § 119 to Japanese Application No. 2013-150965 filed on Jul. 19, 2013 and under 35 U.S.C. § 365 to PCT/JP2014/003781 filed on Jul. 16, 2014.

TECHNICAL FIELD

The present invention relates to a sheet guide device for guiding the sides of a sheet member along a feed guide surface, and to a printer having the sheet guide device.

BACKGROUND

Sheet guide devices having a guide part (anti-skew guide) that guides a side edge of a sheet member (sheet) conveyed along a feed path surface (conveyance path) are known from the literature (see, for example, PTL 1).

PATENT LITERATURE

PTL 1 JP-A-2012-086976

SUMMARY OF INVENTION

The side edges of the sheet member are easily folded in this type of sheet guide device because the sheet members are exposed one sheet at a time to an opposing force from the guide member, unlike the width guides used in the paper cassette that holds multiple sheets of paper. For example, the side edges of a skewed or meandering sheet member contacts (pushes against) the guide surface of the guide member, and the side part of the sheet member may buckle when the side part of the sheet member then lifts away from the feed path surface. This problem is particularly noticeable when the sheet member is roll paper because the side edge of the roll paper continues to push further against the guide member when the roll paper becomes skewed, and the side edge of the sheet member crumples easily.

An objective of the present invention is to provide a sheet guide device that can guide the side edges of a sheet member conveyed along a conveyance path surface while preventing the side portion of the sheet member from wrinkling, and to a printer having the sheet guide device.

A sheet guide device according to the invention includes a crumpling prevention unit having a guide unit with a guide surface that guides a side edge of a sheet member conveyed over a conveyance path surface and prevents crumpling the side portion of the sheet member that contacts the guide surface. The crumpling prevention unit includes a protruding part disposed protruding from the conveyance path surface and causing the side portion of the passing sheet member to rise to the side; a pressure part configured to press the sheet member to the conveyance path surface at the same or adjacent position of the protruding part; and a stop configured to contact the side edge of the sheet member inclined by the protruding part.

Thus comprised, the side portion of a sheet member can be prevented from folding to the face side of the medium as a result of the protruding part causing the side portion of the sheet member to slope up to the side. The side portion of the medium lifting away from the conveyance path surface is also inhibited by the pressure part pushing down at the same or an adjacent position as the inclined side portion. The side portion is also impeded from separating from the conveyance path surface as a result of the side edge of the sheet member being suppressed by the stop. As a result, folding (crumpling) of the side portion due to the side portion lifting away from the conveyance surface can be prevented. The side of the sheet member can thus be prevented from folding, and the side edge of the sheet member conveyed over the conveyance path surface can be guided, by having a crumpling prevention unit including a protruding part, a pressure part, and a stop.

Preferably, the protruding part has an inclined surface formed to rise away from the conveyance path surface to the outside on the transverse axis perpendicular to the conveyance direction; and a contact surface of the stop is at an acute angle to the inclined surface.

By having a contact surface at an acute angle to the inclined surface, the stop in this configuration interferes with the sheet member lifting away from the conveyance path surface due to the side edge of the sheet member sloping. As a result, wrinkling of the side portion due to the side portion lifting up can be effectively prevented.

Further preferably, the guide unit has a first guide that guides one side edge of the sheet member, and a second guide that guides the other side edge of the sheet member; and the crumpling prevention unit is disposed to both the first guide side and the second guide side.

Further preferably, one of the first guide and the second guide is a stationary guide.

Thus comprised, the side edge of the sheet member can be guided when the sheet member is skewed to either side of the conveyance direction because the guide unit has a first guide and a second guide. Furthermore, because the crumpling prevention unit is disposed to both the first guide and the second guide, wrinkling of the side portion of the sheet member can be prevented when the sheet member is skewed to either side of the conveyance direction.

Yet further preferably, the crumpling prevention unit is disposed at both the upstream end and the downstream end of the guide unit in the conveyance direction.

Thus comprised, wrinkling of the side portion of the sheet member can be effectively prevented by disposing the crumpling prevention unit at both the upstream end and the downstream end of the guide unit against which the skewed sheet member is pushed forcefully.

Yet further preferably, the sheet member is die-cut label paper made by die-cutting a continuous label medium affixed to a liner, removing the waste, and having an incision made in the liner by the die-cutting process at a position a specific distance from the side edge of the liner, or is continuous label paper made by removing the waste after making an incision in the liner only at a position a specific distance from the side edge of the liner, and the sheet member is conveyed with the opposite side of the liner as the side to which the label is affixed against the conveyance path surface; and the protruding part is configured to incline the side portion of the sheet member including the position where the incision is made.

Because both die-cut label paper and continuous label paper have an incision formed in the surface to which the label medium is affixed, the label paper can fold and wrinkle easily to the label side at the position where the incision is formed. However, because the protruding part causes the portion of the die-cut label paper or continuous label paper including the part where the incision is formed to slope up, it works in the direction causing the incision made by the die-cutting process to close, and the side portion can be prevented from folding up to the label side at the incision.

A printing device according to the invention includes the sheet guide device described above; a conveyance unit that conveys the sheet member; and a print unit that prints on the sheet member downstream in the conveyance direction from the sheet guide device.

By disposing the print unit downstream in the conveyance direction from a sheet guide device that can guide the side edges of a sheet member conveyed along a conveyance path surface while preventing the sides of the sheet member from wrinkling, printing is possible on a sheet member that is guided widthwise while preventing wrinkling the sides of the sheet member.

DETAILED DESCRIPTION

A printer according to a preferred embodiment of the invention is described below with reference to the accompanying figures. This printer is an inkjet printer that prints on die-cut label paper and other print media. The printer connects by wire or wirelessly to a personal computer, smartphone, tablet computer, or other data processing terminal through a USB (Universal Serial Bus) cable or LAN (local area network), and prints based on print data sent from the data processing terminal.

Figure 1A:
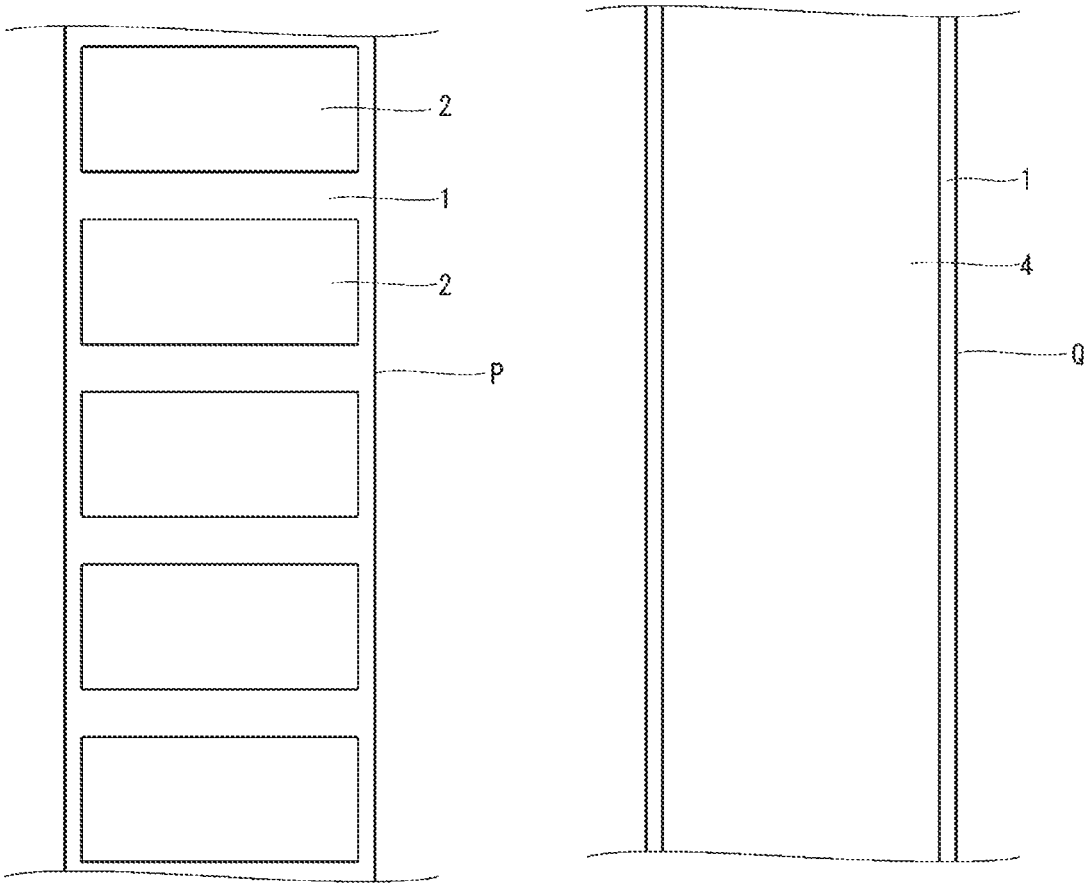
FIGS. 1A and 1B illustrate die-cut label paper and continuous label paper as examples of print media, 1A being a plan view and 1B being a partial section view common to both.
Figure 1B:
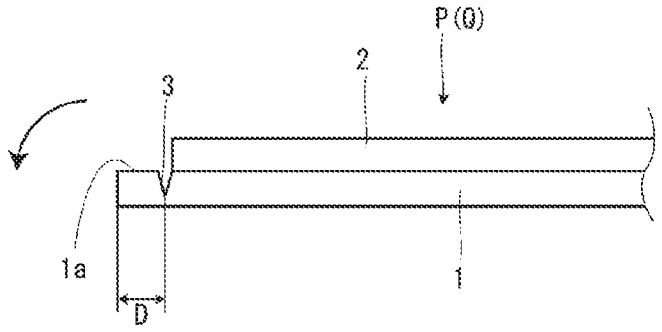

As shown in FIGS. 1A and 1B, die-cut label paper P (sheet member) used as the print medium has a continuous web liner 1, and multiple labels 2 adhesively affixed at a uniform interval to the coated side la of the liner 1. The die-cut label paper P is the result of forming consecutive labels on the liner 1 by a die-cutting process and then stripping the non-label waste. An incision 3 produced in the die-cutting process is formed in the coated side la of the liner 1 at a position separated a specific distance (margin D) from the edge of the liner 1. This margin D is typically several millimeters, for example. As indicated by the arrow in FIG. 1B, the die-cut label paper P can be easily folded back to the coated side la forming a protrusion at the position where the incision 3 is formed.

Figure 2A:
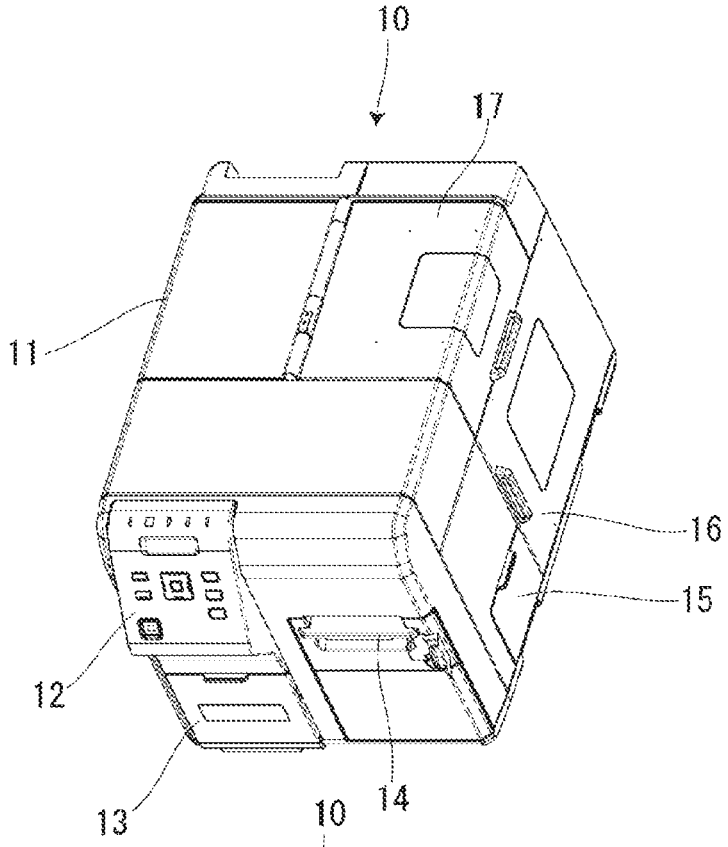
FIGS. 2A and 2B are external oblique views of a printer according to a preferred embodiment of the invention, 2A showing the printer when the access cover is closed, and 2B showing the printer with the access cover open.
Figure 2B:
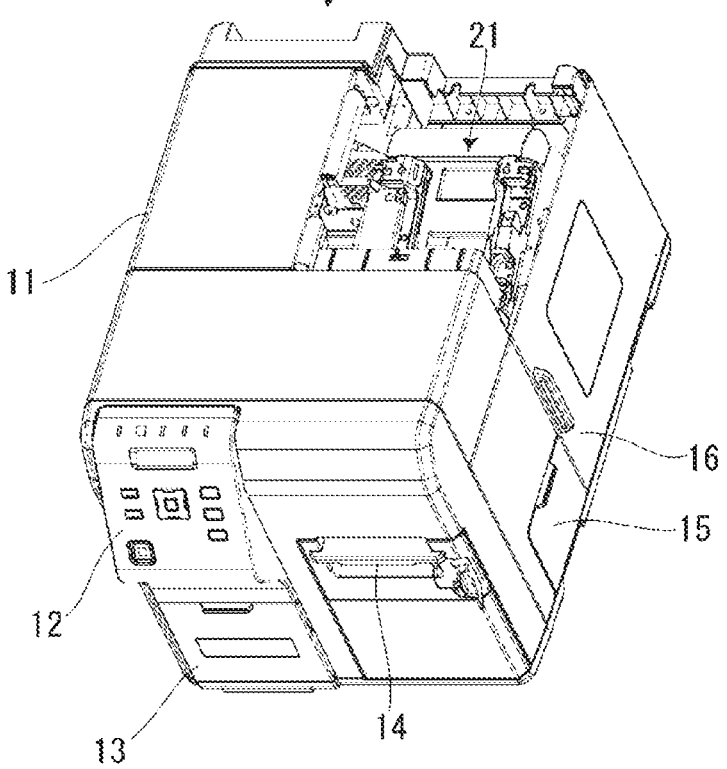

As shown in FIGS. 2A and 2B, the printer 10 has a box-like printer case 11. An operating panel 12 populated with operating buttons is disposed to the top left part of the front of the printer case 11, and a pull-out ink cartridge replacement opening 13 is formed below the operating panel 12. A paper discharge slot 14 from which the printed die-cut label paper P is discharged is formed in the middle of the right front side of the printer case 11.

A waste ink tank replacement opening 15 is disposed to the bottom front side of the right side of the printer case 11, and a large roll paper supply opening 16 is disposed towards the back beside the waste ink tank replacement opening 15. A roll paper compartment 20 (see FIG. 3) is formed inside the roll paper supply opening 16, and the die-cut label paper P wound into a roll with the coated side la to the outside is loaded in the roll paper compartment 20 for delivery through the conveyance path. The user loads a roll of die-cut label paper P into the roll paper compartment 20 from the roll paper supply opening 16.

An access cover 17 that opens to the side pivoting on a hinge disposed substantially in the middle of the case top is also disposed to the printer case 11. A guide unit 21 (sheet guide device) that prevents skewing of the conveyed die-cut label paper P is housed inside the access cover 17.

Figure 3:
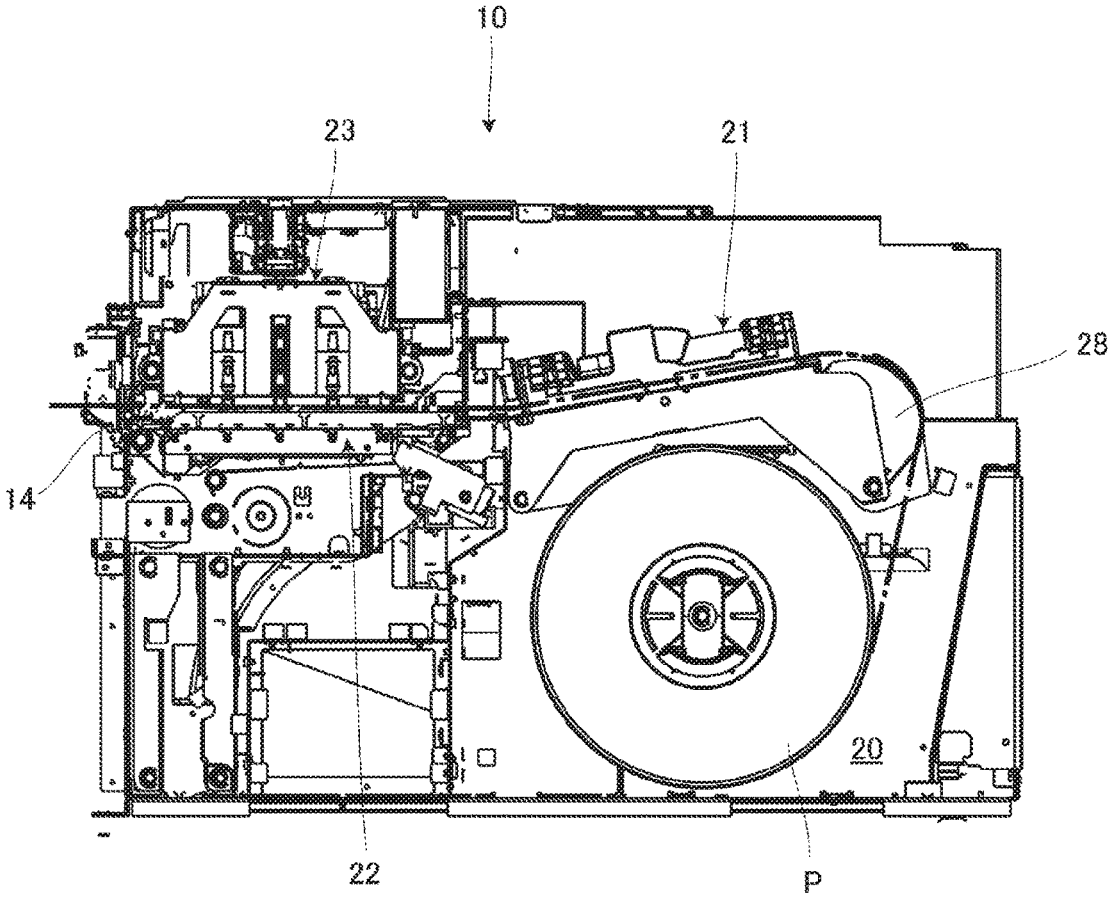
FIG. 3 is a side section view of the printer.

As shown in FIG. 3, the printer 10 has a roll paper compartment 20, a guide unit 21 disposed above the roll paper compartment 20, a feed unit 22 that conveys the die-cut label paper P pulled from the roll paper compartment 20, and a print unit 23 that prints with an inkjet head on the labels 2 of the conveyed die-cut label paper P. The feed unit 22 has multiple rollers disposed along the conveyance path, and a motor that drives the rollers, and is configured to convey the die-cut label paper P forward and reverse.

In the following description of the guide unit 21, referenced to the forward conveyance direction in which the die-cut label paper P is fed toward the paper discharge slot 14, the upstream side of the conveyance direction is also referred to as the "front," and the downstream side in the conveyance direction is also referred to as the "back." The right side when facing downstream in the conveyance direction is also referred to as the right, and the left side as the left. The directions perpendicular to the surface of the feed plate 25 (described below) of the guide unit 21 are also referred to as "up" and "down." These directions are for convenience of description only, and embodiments of the invention are obviously not limited to these directions.

Figure 4:
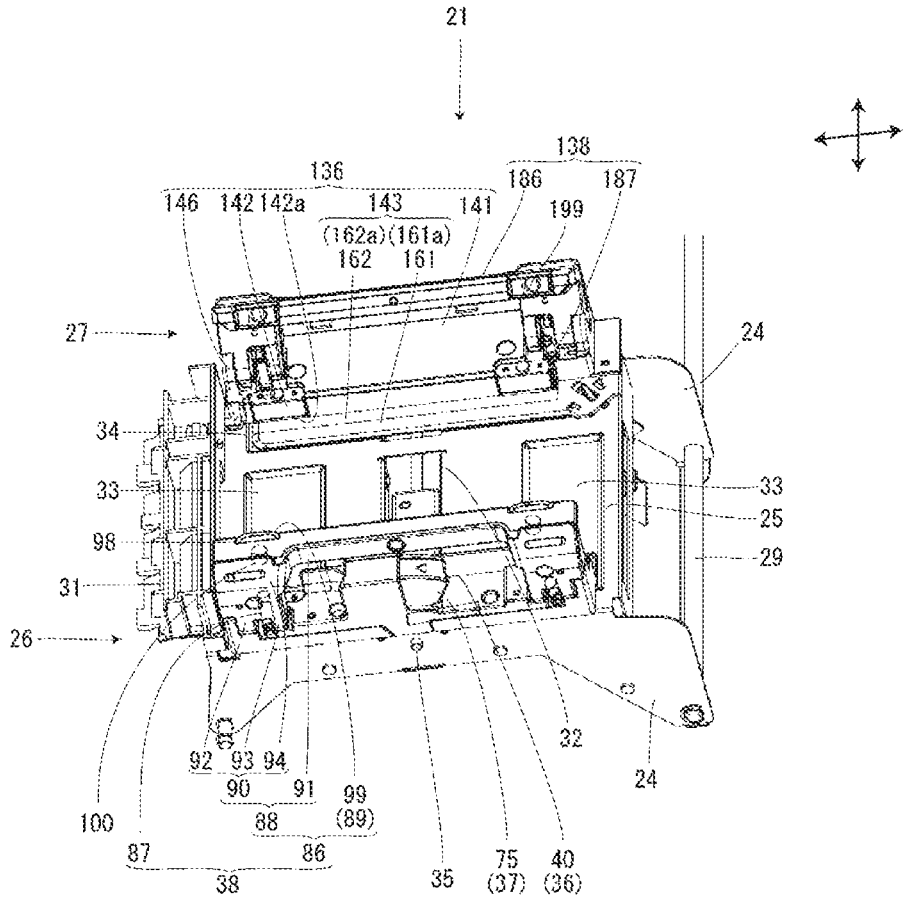
FIG. 4 is an oblique view of a guide unit in the printer when the movable-side presser lever and the stationary-side presser lever are rotated to the release position.
Figure 5:
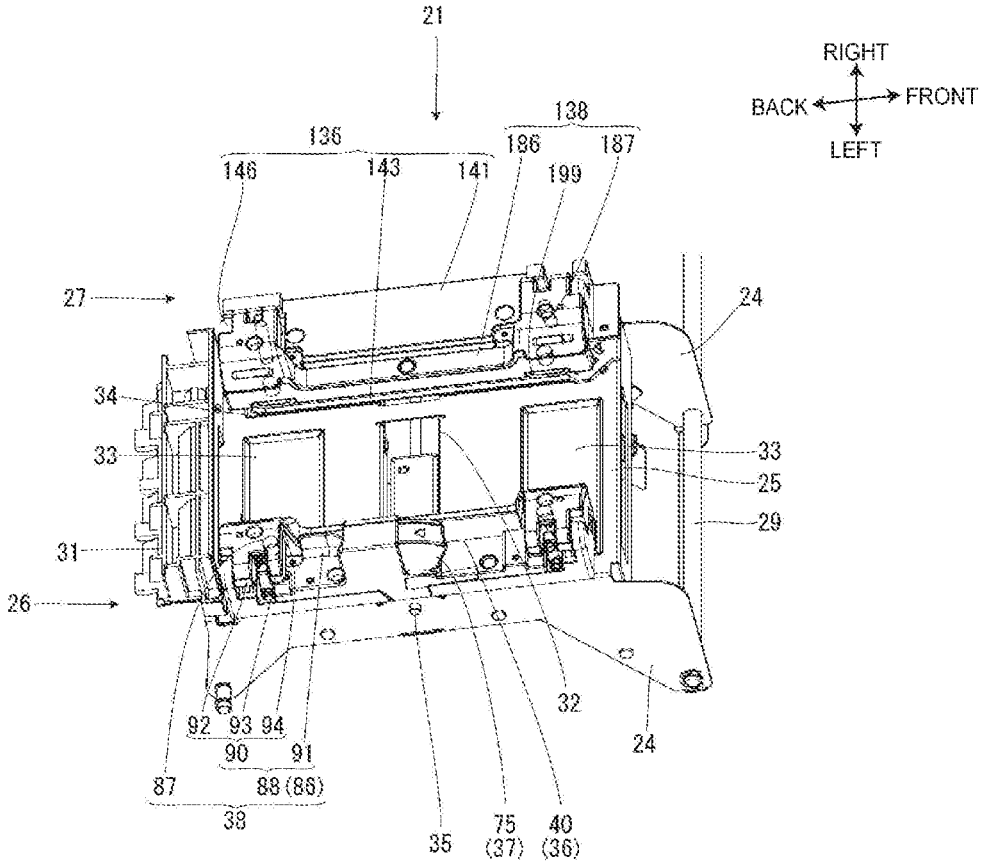
FIG. 5 is an oblique view of the guide unit in the printer when the movable-side presser lever and the stationary-side presser lever are rotated to the pressure position.

As shown in FIG. 4 and FIG. 5, the guide unit 21 has support frames 24 on the left and right, a substantially rectangular feed plate 25 disposed between the left and right support frames 24, a movable part 26 (first guide) disposed on the left side part of the feed plate 25, and a stationary part 27 (second guide) disposed on the right side part of the feed plate 25.

A tension rod 29 pivotably supporting a tension lever 28 (FIG. 3) that applies desirable tension to the conveyed die-cut label paper P is fixed at the front end of the support frames 24. A roller cover 31 that houses a feed roller that feeds the die-cut label paper P pulled by the user from the roll paper compartment 20 toward the print unit 23 is supported above the back end of the feed plate 25. When setting the die-cut label paper P to the feed plate 25, the user sets the leading end of the die-cut label paper P pulled from the roll paper compartment 20 against the feed roller. The die-cut label paper P is set at this time so that the coated side la is exposed, that is, so that the coated side la is on top.

The support frames 24 are substantially rectangular panels with a large trapezoidal notch formed in the bottom. A guide shaft 35 described below is fastened in the middle of the support frames 24. The sides of the feed plate 25 are supported on top of the support frames 24.

The feed plate 25 is a substantially rectangular panel, and the die-cut label paper P is conveyed over the top surface (feed path surface) of the feed plate 25. A rectangular guide window 32 that is long on the transverse axis is formed in the middle of the feed plate 25. A box unit 45 described below is disposed so that it can slide in this guide window 32 widthwise to the printer (on the transverse axis).

A shallow, substantially rectangular guide recess 33 that is long on the transverse axis is formed both in front and back of the guide window 32 in the feed plate 25. A movable-side pressure bearing member 43 (see FIG. 6) described below is also disposed in each guide recess 33. A shallow, substantially rectangular stationary-side recess 34 that is long on the longitudinal axis is formed on the right side part of the feed plate 25. A stationary-side pressure bearing member 143 described below is press-fit into the stationary-side recess 34.

The movable part 26 includes the guide shaft 35 extending transversely, a movable guide 36 configured to slide on the guide shaft 35, a lock mechanism 37 that locks and unlocks the movable guide 36 to the guide shaft 35, and a movable-side presser mechanism 38 that is disposed to the movable guide 36 and applies pressure to the left side of the die-cut label paper P. Note that the guide shaft 35 is grounded through the support frames 24 described above.

Figure 6:
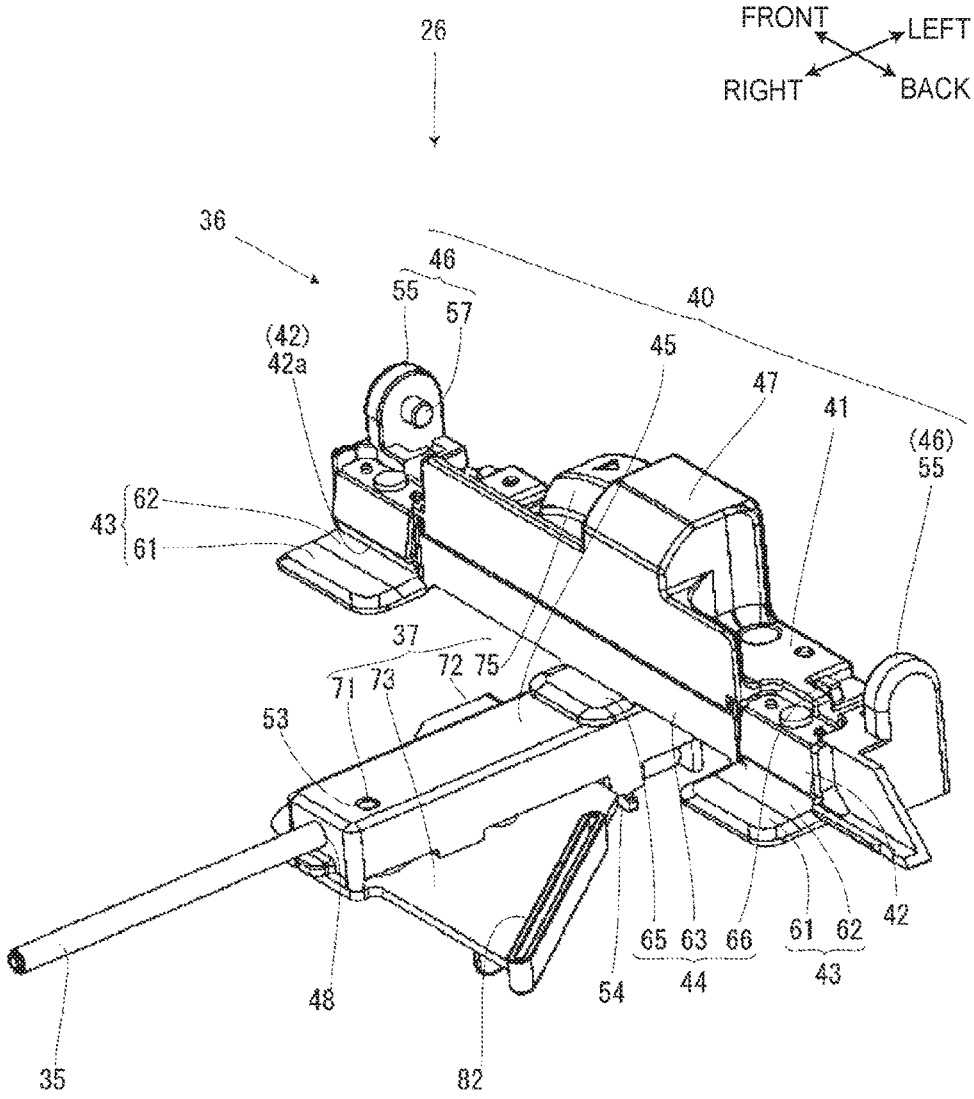
FIG. 6 is an oblique view of the movable part (not including the movable-side presser mechanism) of the guide unit.
Figure 7:
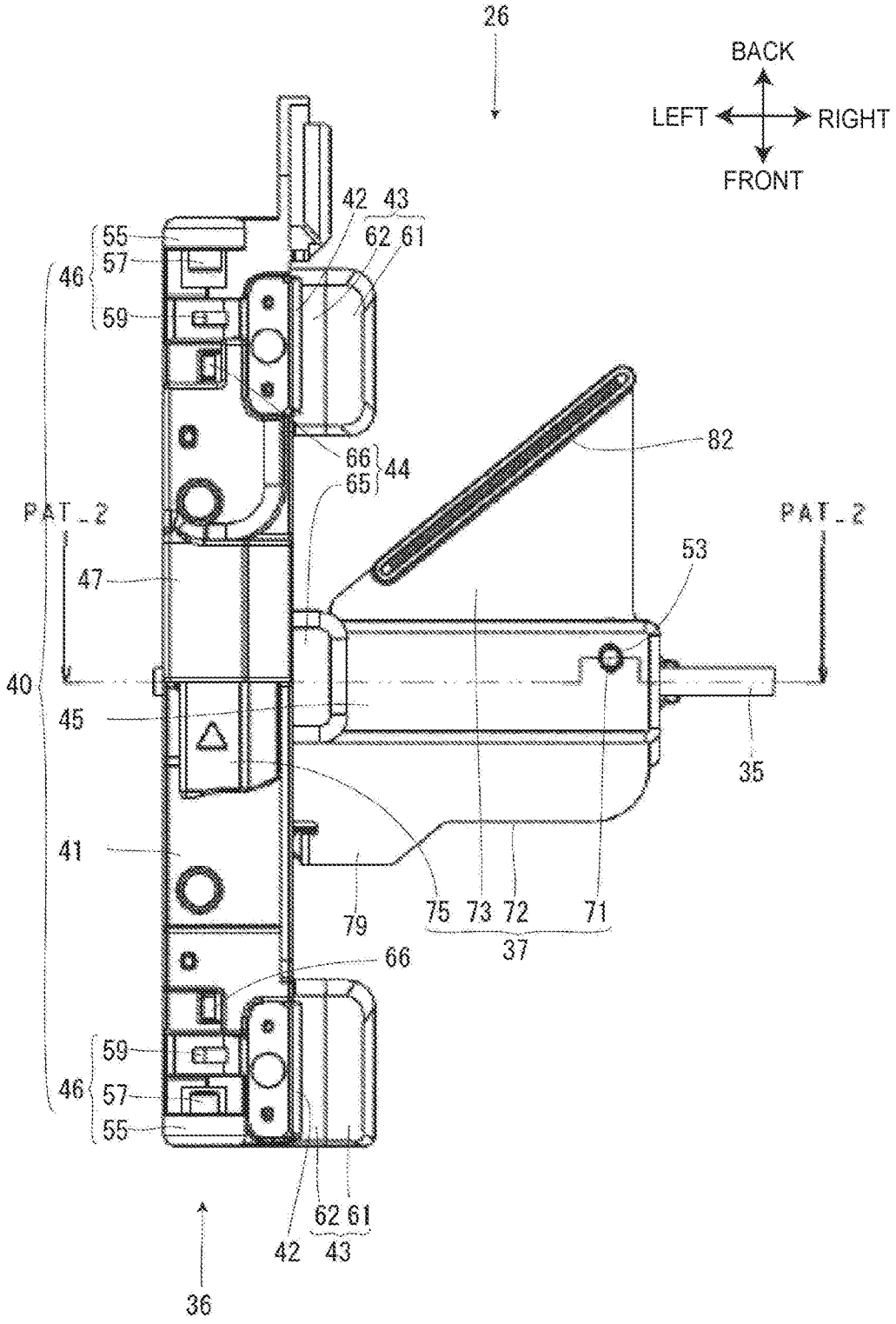
FIG. 7 is a plan view of the movable part (not including the movable-side presser mechanism).
Figure 8:
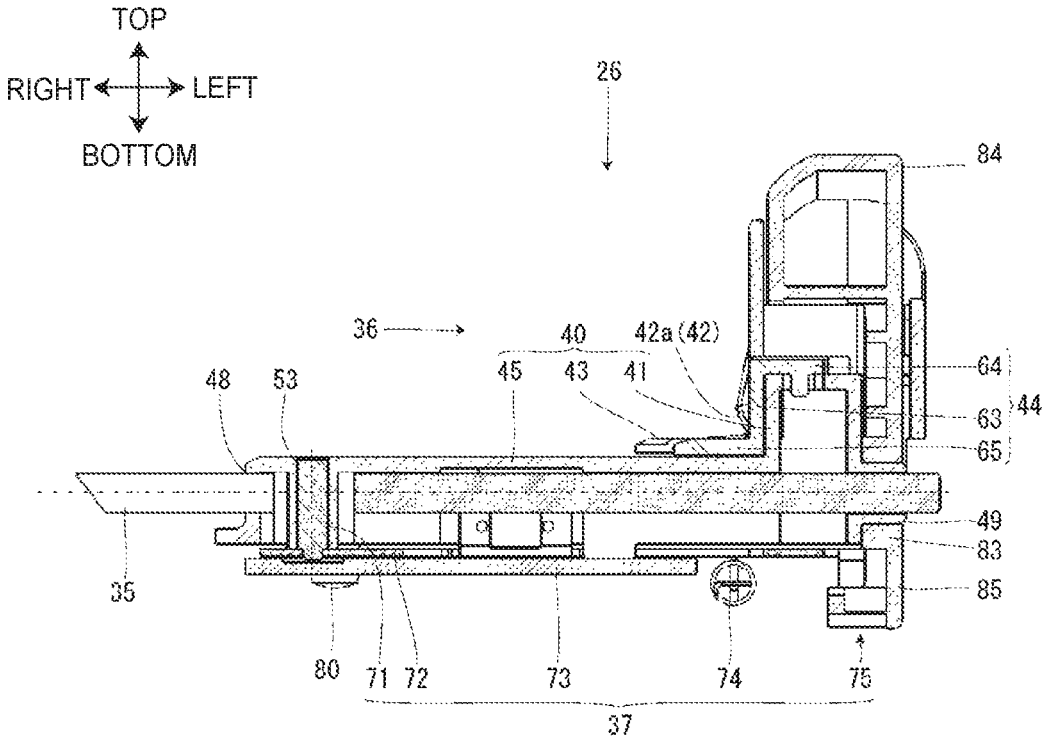
FIG. 8 is a section view of the movable part (not including the movable-side presser mechanism) through the dotted line in FIG. 7.

As shown in FIG. 6 to FIG. 8, the movable guide 36 includes a base 40 attached slidably to the guide shaft 35; two side presser members 42 (stops) attached to the front and back ends of the base 40; and a retractable slider 44 that is attached to the base 40 between the two front and back side presser members 42 and can slide toward and away from the die-cut label paper P.

The base 40 includes a base unit 41 disposed extending on the longitudinal axis to the feed plate 25; a basically rectangular box unit 45 extending to the right from the bottom middle part of the base unit 41; two movable-side pressure bearing members 43 disposed to the front and back ends of the base unit 41 opposite the side presser members 42; and two presser lever supports 46 formed at the front and back ends of the base unit 41. A release lever cover 47 formed to cover the right and left top of a lock release lever 75 described below is disposed to the top of the base unit 41 in the middle between the front and back. The release lever cover 47 also functions as a grip used by the user to rotate the lock release lever 75 to the released position (described below).

The box unit 45 is basically rectangular with an open bottom, and is supported slidably on the transverse axis by the guide shaft 35. A guide shaft hole 48 through which the guide shaft 35 passes is formed in the right side of the box unit 45. A short tubular guide tube sleeve 49 is formed protruding from the left side of the box unit 45, and the guide shaft 35 passes through this guide tube sleeve 49. The lock release lever 75 is supported to pivot in the longitudinal direction on the guide shaft 35 through this guide tube sleeve 49.

A lock hole 53 shaped like a bottomless trench that is slightly longer on the longitudinal axis is formed in the top right back corner of the box unit 45. A lock pin 71 described below is fit into this oval lock hole 53. A lock spring catch 54 that holds the back end of a lock spring 74 described below is also formed at the back on the left side of the box unit 45.

The presser lever supports 46 formed at the front and back ends of the base unit 41 each have a shaft support stand 55 protruding in an inverted, substantially U-shaped configuration, and a short columnar support boss 57 is formed protruding from the mutually opposing faces of the two shaft support stands 55. A lever spring bottom catch 59 that holds the bottom end of a lever spring 87 described below is also formed near the inside ends of the two shaft support stands 55.

The side presser members 42 are attached to the front and back ends on the right side of the base unit 41. Each side presser member 42 is made from a flat rectangular member that bends to the right side horizontally near the bottom, and the portion below the bend is a stop 42*a*. The left edge of the die-cut label paper P is inclined by a pressure-bearing base unit 62 described below and contacts the stop 42*a*. The left edge of the die-cut label paper P is therefore prevented from lifting up, and wrinkles along the left edge due to the left side of the media lifting up are prevented.

Each movable-side pressure bearing member 43 protrudes substantially rectangularly to the right from the bottom of the right side of the base unit 41, and has a pressure-bearing end 61 at the distal end and the pressure-bearing base unit 62 (protrusion) at the base.

Figure 9A:
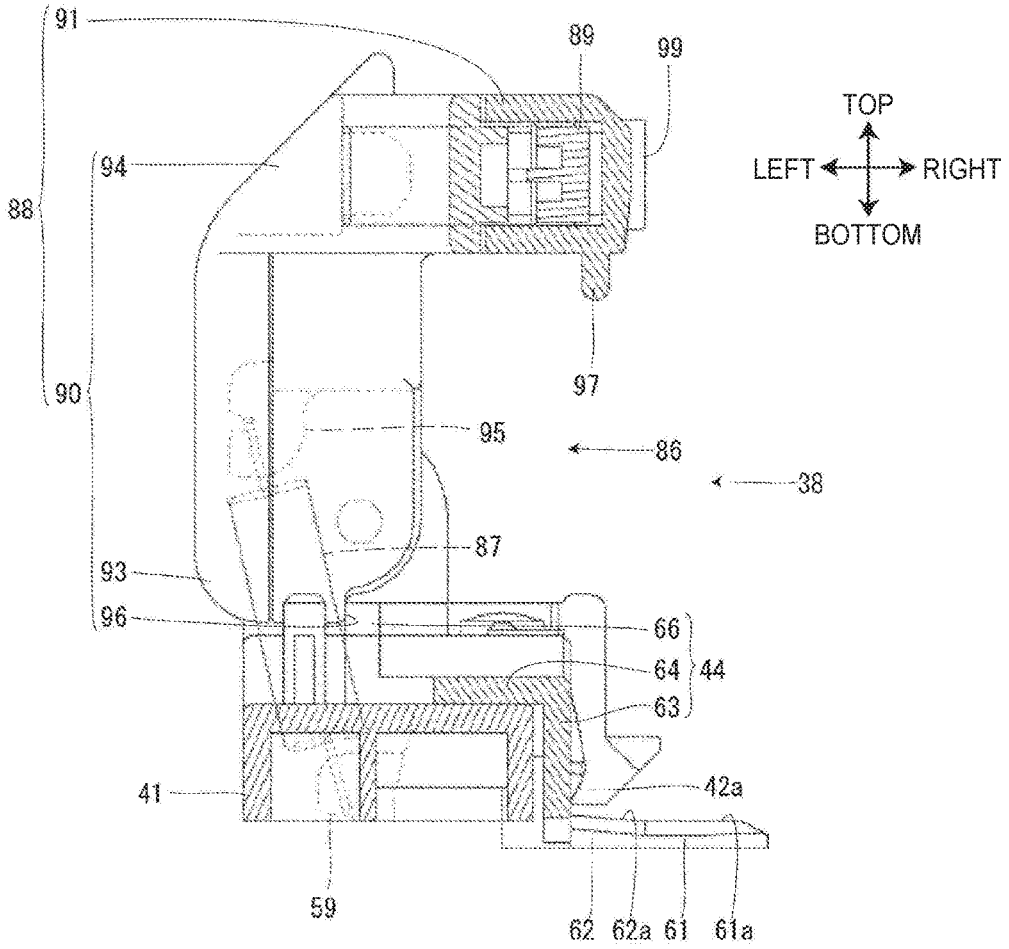
FIGS. 9A and 9B are section views of the movable-side presser mechanism through the dotted line in FIG. 11, 9A showing when the movable-side presser lever is rotated to the release position, and 9B showing when the movable-side presser lever is rotated to the pressure position.
Figure 9B:
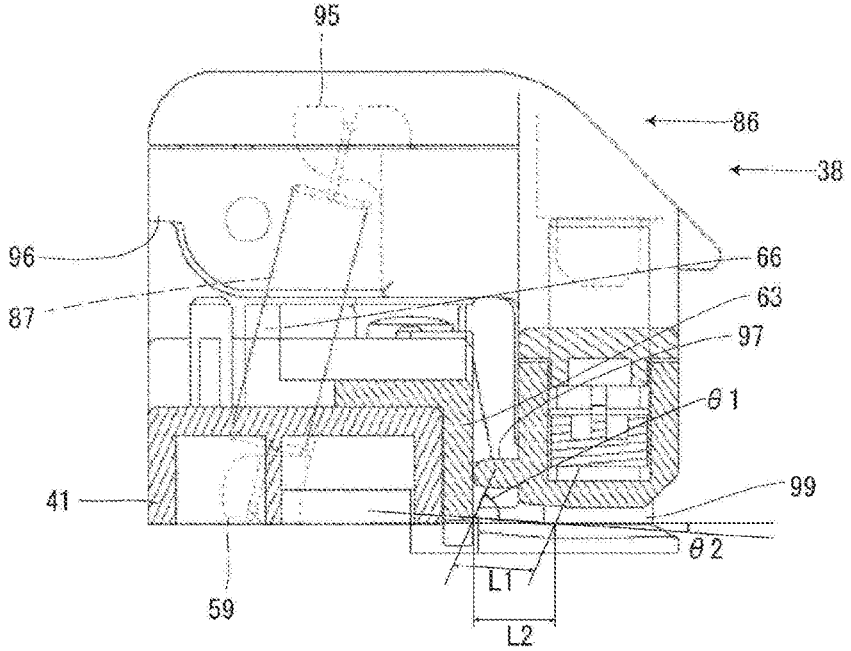

As shown in FIGS. 9A and 9B, the pressure-bearing end 61 is the part that receives pressure from the movable-side presser lever 86 on the left side of the die-cut label paper P. The top (flat surface 61*a*) of the pressure-bearing end 61 is substantially flush with the top of the feed plate 25. The pressure-bearing base unit 62 is formed projecting toward the flat surface 61*a*. More specifically, the top (inclined surface 62*a*) of the pressure-bearing base unit 62 is an incline that rises from the flat surface 61*a* toward the base. This inclined surface 62*a* causes the left side of the die-cut label paper P to slope upward toward the left side. This works in the direction closing the incision 3, and the left side of the die-cut label paper P is prevented from folding and buckling to the coated surface side (top surface).

The stop 42*a* is at an angle θ1 to the inclined surface 62*a*. This angle θ1 is preferably acute, and further preferably 45° to 70°. If the angle is within this range, the stop 42*a* can press effectively against the left edge of the die-cut label paper P. The inclined surface 62*a* is at an angle θ2 to the flat surface 61*a*. This angle θ2 is preferably 2° to 11°. If the angle is in this range, crumpling of the left side of the die-cut label paper P can be effectively prevented. The length of the inclined surface 62*a* is preferably greater than the margin D to the incision 3 in the die-cut label paper P. This enables causing the left edge of the die-cut label paper P to incline (rise), including the position where the incision 3 that can fold easily is formed.

The movable-side pressure bearing members 43 are disposed so that they are inside the front and back guide recesses 33 described above, and the movable-side pressure bearing members 43 can slide transversely guided front and back by the front and back walls of the guide recesses 33. As a result, the movable guide 36 can slide transversely without tilting at an angle to the front and back.

As shown in FIG. 6 to FIG. 9B, the retractable slider 44 has an inverted, substantially L-shaped configuration in section view, having a slider guide 63 with a guide surface that contacts the left side of the die-cut label paper P, and a slider top wall 64 extending left from the top of the slider guide 63. A slider foot 65 is formed extending to the right from the bottom middle of the slider guide 63. A slider stop 66 that engages the presser lever stop 96 of the movable-side presser lever 86 described below is formed at the front and back ends of the retractable slider 44.

The retractable slider 44 moves slightly (such as 0.5 mm) between an advanced position and a retracted position relative to the die-cut label paper P in conjunction with the pivoting action of the movable-side presser lever 86 described below. As described in further detail below, when the movable-side presser lever 86 pivots to the release position, the retractable slider 44 advances to the advanced position, and when the movable-side presser lever 86 pivots to the pressure position, the retractable slider 44 retracts to the retracted position.

The slider guide 63 is basically rectangular and long on the longitudinal axis, and is perpendicular to the top of the feed plate 25. A slider pusher 97 (described below) of the movable-side presser lever 86 contacts the slider guide 63 when the movable-side presser lever 86 pivots to the pressure position. The slider top wall 64 is supported on the top of the above base unit 41.

The slider foot 65 fits into the guide window 32 described above, and the top of the slider foot 65 is substantially flush with the top of the feed plate 25. The slider foot 65 slides over the top of the box unit 45 while guided longitudinally by the front and back edges of the guide window 32. As a result, the retractable slider 44 can move forward and back transversely without tilting at an angle to the longitudinal axis.

The slider stop 66 engages the presser lever stop 96 of the movable-side presser lever 86 when the movable-side pressure lever 86 is rotated to the release position, and disengages the presser lever stop 96 when the movable-side presser lever 86 rotates to the pressure position.

The retractable slider 44 thus comprised is pushed by the presser lever stop 96 engaged by the slider stop 66 when the movable-side presser lever 86 pivots to the release position, and advances to the advanced position (FIG. 9A). When the movable-side presser lever 86 pivots to the pressure position, the presser lever stop 96 disengages from the slider stop 66, the slider guide 63 is pushed by the slider pusher 97, and the retractable slider 44 retracts to the retracted position (FIG. 9B).

As shown in FIG. 6 to FIG. 8 and FIGS. 10A-10C, the lock mechanism 37 has a lock plate 72 to which the lock pin 71 that enters the oval lock hole 53 of the box unit 45 is perpendicularly disposed; a support plate 73 that supports the lock plate 72 pivotably between the support plate 73 and the box unit 45; a lock spring 74 that urges the lock plate 72 rotationally; and a lock release lever 75 for rotating the lock plate 72 in resistance to the lock spring 74.

The lock plate 72 is a plate of steel or other metal, long on the transverse axis, and basically L-shaped horizontally. A lock tab 76 is formed vertically at a position near the back right side of the lock plate 72. A rubber or other dielectric friction member 77 is attached to the lock tab 76.

The friction member 77 and the lock pin 71 are disposed on the front and back sides of the guide shaft 35. The lock plate 72 is configured pivotably between a locked position (FIG. 10A) where the lock pin 71 and friction member 77 contact the guide shaft 35, and an unlocked position (FIG. 10C) where the lock pin 71 and friction member 77 are separated from the guide shaft 35.

The lock pin 71 is a columnar metal pin that is crimped to the right back end part of the lock plate 72. The diameter of the lock pin 71 is substantially the same as the width of the oval lock hole 53, and the lock pin 71 is fit into the oval lock hole 53. As a result, the box unit 45 (movable guide 36) in which the oval lock hole 53 is formed is positioned on the transverse axis to the lock plate 72. As the lock plate 72 pivots, the lock pin 71 moves along the oval lock hole 53. Because the lock pin 71 is round, there is no play between the lock pin 71 and the oval lock hole 53 (box unit 45) even when the lock pin 71 moves in the oval lock hole 53 in conjunction with the lock plate 72 pivoting. As a result, when the lock plate 72 rotates to the lock position, the lock plate 72 can be locked to the guide shaft 35 with no chatter in the movable guide 36.

A release lever stop 78 is formed downward from the back left part of the lock plate 72. The bottom end (release lever operator 85) of the lock release lever 75 contacts the release lever stop 78. A front lock spring catch 79 is formed curving to the left near the front left side of the lock plate 72. The front end of the lock spring 74 is engaged with the distal end of the front lock spring catch 79. A through-hole 81 (unthreaded hole) through which a set screw 80 described below passes and which is large enough to allow the lock plate 72 to pivot is formed near the lock pin 71.

The support plate 73 is disposed covering the bottom of the box unit 45 with the lock plate 72 therebetween, and is fastened to the box unit 45 by the set screw 80, the distal end of which is threaded into the top of the box unit 45. As a result, the lock plate 72 is supported pivotably on the support plate 73.

A resistor guide 82 that engages the detection lever (not shown in the figure) of a variable resistor that detects the position of the movable guide 36 (the position widthwise to the die-cut label paper P) is also disposed to the support plate 73.

The lock spring 74 is a tension spring, the front end held by the front lock spring catch 79 of the lock plate 72, and the back end held by the lock spring catch 54 of the box unit 45. The lock spring 74 urges the lock plate 72 to rotate to the locked position (clockwise as seen in the figures).

The lock release lever 75 is shaped like an inverted P when seen in vertical section, and is pivotably supported on the guide shaft 35 through the guide tube sleeve 49 of the box unit 45. The lock release lever 75 has a release lever insertion unit 83 formed near the bottom of the box unit 45, a release lever grip 84 formed at the top, and a release lever operator 85 formed at the bottom. The release lever operator 85 engages the release lever stop 78 of the lock plate 72.

The lock release lever 75 pivots between an unreleased position where the release lever grip 84 is exposed to the front from the release lever cover 47, and a released position where the release lever grip 84 is inside the release lever cover 47. More specifically, the lock release lever 75 is urged to the unreleased position by the lock spring 74 through the lock plate 72. When the user holds the release lever grip 84 and rotates the lock release lever 75 to the release position in resistance to the lock spring 74, the lock plate 72 rotates from the locked position to the unlocked position.

Figure 10A:
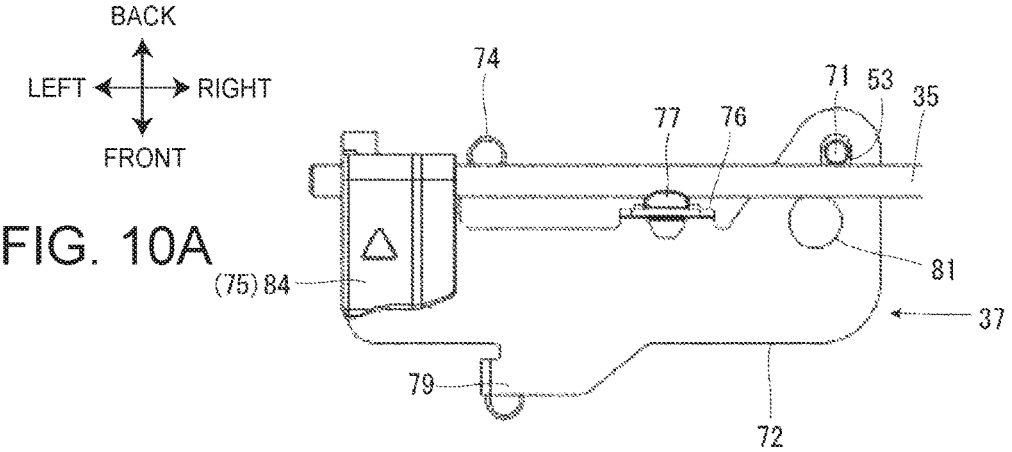
FIGS. 10A-10C are plan views of the lock mechanism of the movable part, 10A showing when the lock plate is rotated to the locked position, 10B showing the lock plate rotated to a middle position, and 10C showing the lock plate rotated to the unlocked position.
Figure 10B:
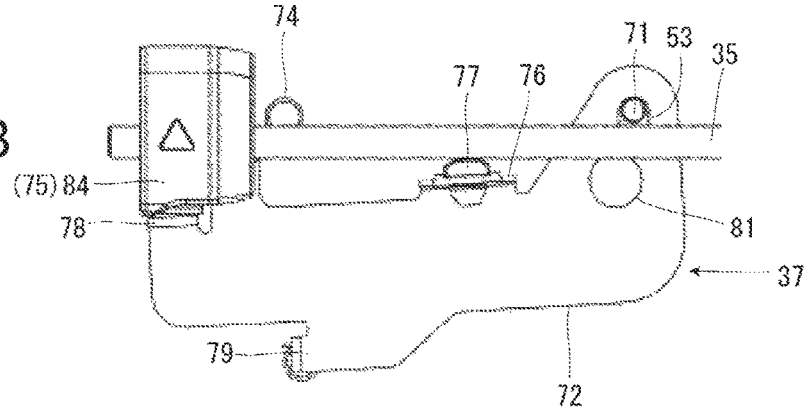
Figure 10C:
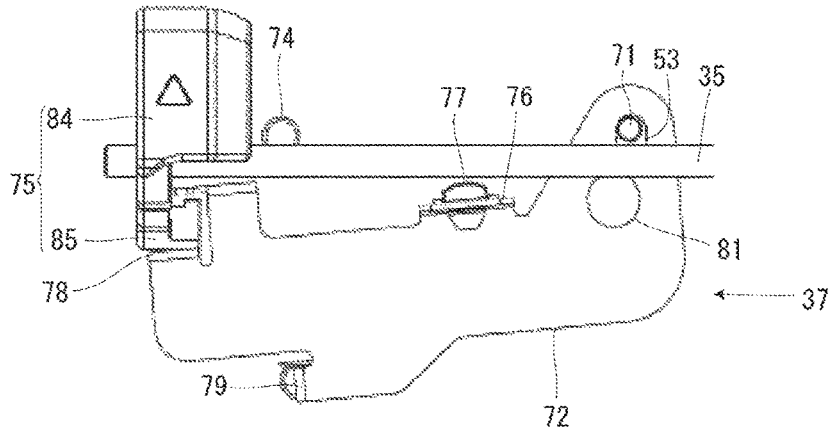

As shown in FIGS. 10A-10C, because the friction member 77 and the lock pin 71 of the lock plate 72 are disposed on the front and back sides of the guide shaft 35 in the lock mechanism 37 thus comprised, the friction member 77 is urged by the lock spring 74 to pivot on the lock pin 71 and rotate relative to the guide shaft 35, and the lock pin 71 is urged by the lock spring 74 to pivot on the friction member 77 and rotate relative to the guide shaft 35, when the lock plate 72 rotates to the locked position (FIG. 10A). More specifically, when the lock plate 72 pivots to the lock position, force is applied from the friction member 77 to the guide shaft 35 using the lock pin 71 in contact with the guide shaft 35 as the fulcrum, and using the distal end of the front lock spring catch 79 on which the lock spring 74 is engaged as the point of effort. Force using the friction member 77 in contact with the guide shaft 35 as the fulcrum, and the distal end of the front lock spring catch 79 as the point of effort, is also applied from the lock pin 71 to the guide shaft 35.

When the user rotates the lock release lever 75 to the release position in resistance to the lock spring 74, the lock plate 72 pivots counterclockwise in the drawing using the friction member 77 in contact with the guide shaft 35 as a fulcrum until the lock pin 71 contacts the back end of the oval lock hole 53 (the middle position shown in FIG. 10B). The lock plate 72 also pivots using the lock pin 71 in contact with the back end of the oval lock hole 53 as a fulcrum from the middle position to the unlocked position (FIG. 10C) where the friction member 77 is separated from the guide shaft 35. The user can then slide the movable part 26.

After the user slides the movable part 26 and releases the lock release lever 75, the urging force of the lock spring 74 causes the lock plate 72 to pivot on the lock pin 71 in contact with the back end of the oval lock hole 53 clockwise as seen in the figures from the unlocked position to the middle position where the friction member 77 is in contact with the guide shaft 35. The lock plate 72 then continues pivoting clockwise from the middle position to the lock position using the friction member 77 in contact with the guide shaft 35 as the fulcrum. When the lock plate 72 rotates from the unlocked position to the locked position, the lock plate 72 thus rotates first to a middle position where the friction member 77 contacts the guide shaft 35, and then pivots on the friction member 77 until the lock pin 71 contacts the guide shaft 35 at the locked position. As a result, both the friction member 77 and the lock pin 71 can be made to positively contact the shaft member without requiring strict dimensional precision in the lock plate 72.

Note that in this embodiment the lock pin 71 and the friction member 77 both contact the guide shaft 35 to produce friction (lock) and position the movable guide 36 to the lock plate 72 as described above, but separate parts may be provided for locking and for positioning.

Figure 11:
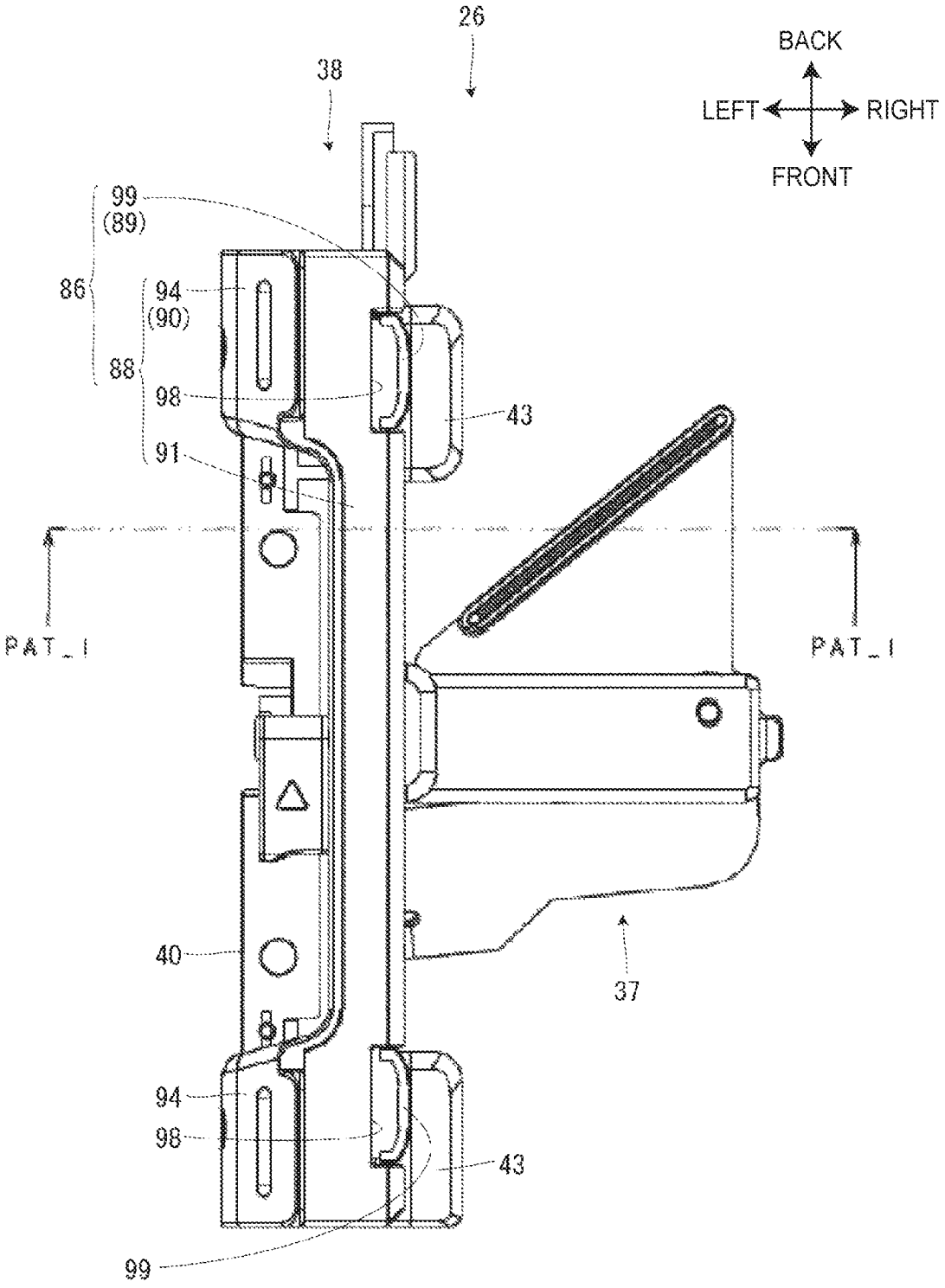
FIG. 11 is a plan view of the movable part.

As shown in FIG. 4, FIG. 5, FIGS. 9A and 9B. and FIG. 11, the movable-side presser mechanism 38 has movable-side presser levers 86 that are C-shaped in top view and are supported pivotably on the two presser lever supports 46, and two lever springs 87 disposed to the presser lever supports 46.

While allowing conveyance of the die-cut label paper P, the movable-side presser lever 86 presses the left edge of the die-cut label paper P to the flat surface 61*a* of the pressure-bearing end 61 described above. Because this prevents the left edge of the die-cut label paper P from lifting away from the flat surface 61*a* of the pressure-bearing end 61, creasing along the left edge due to the left edge lifting up is prevented.

The movable-side presser lever 86 is configured pivotably between the released position (FIG. 9A) where the distal end (sheet presser part 99 described below) is separated from the die-cut label paper P, and a pressure position (FIG. 9B) where the die-cut label paper P is pressed to the flat surface 61*a* by the distal end. To convey the die-cut label paper P for a printing process, for example, the user rotates the movable-side presser levers 86 to the pressure position. As a result, the die-cut label paper P is conveyed with the left edge held down by the movable-side presser levers 86. To load die-cut label paper P on the feed plate 25, for example, the user rotates the movable-side presser levers 86 to the release position. As a result, the user can easily set the die-cut label paper P on the feed plate 25.

The movable-side presser lever 86 includes a clamshell-like presser lever case 88, and two (front and back) sheet presser arms 89 housed inside the presser lever case 88. The presser lever case 88 has a substantially rectangular presser lever end part 90 on both front and back ends, and a pressure lever connector 91 that connects the two presser lever end parts 90.

Each presser lever end part 90 has an outside protrusion 92 and an inside protrusion 93 formed protruding from the pivot base end (left side), and a presser lever grip 94 formed at the distal end (right side). The two outside protrusions 92 are disposed on the outside front and back with the two inside protrusions 93 therebetween.

A presser lever pivot hole (not shown in the figure) that the support boss 57 engages from the front or back outside side is formed in each outside protrusion 92. Each outside protrusion 92 is formed as a curved surface that curves from the top down the left side, and continues from the left side curving along the bottom through a shoulder.

A top lever spring catch 95 that holds the top end of the lever spring 87 protrudes from an outside front or back surface (the surface opposite the adjacent outside protrusion 92) of each inside protrusion 93. Like the outside protrusion 92, the inside arm part of each presser lever is formed as a curved surface that curves from the top down the left side, and continues from the left side curving along the bottom through a shoulder. This shoulder is the presser lever stop 96 that engages the slider stop 66 of the retractable slider 44. More specifically, when the movable-side presser lever 86 rotates to the release position, the presser lever stop 96 contacts the slider stop 66 (FIG. 9A), and when the movable-side presser lever 86 rotates to the pressure position, the presser lever stop 96 separates from the slider stop 66 (FIG. 9B).

Note that the shoulder of each outside protrusion 92 may engage the slider stop 66 of the retractable slider 44 together with the presser lever stop 96 of the inside protrusion 93 or instead of the presser lever stop 96.

As seen from the conveyance direction, the pressure lever connector 91 is formed at substantially 90° to the presser lever end parts 90. Slider pushers 97 protrude at two (front and back) locations from the left side of the pressure lever connector 91, that is, from the surface opposite the slider guide 63 of the retractable slider 44 in the pressure position. When the movable-side presser lever 86 pivots to the pressure position, the two slider pushers 97 push against the slider guide 63, and the retractable slider 44 retracts to the retracted position (FIG. 9B). When the movable-side presser lever 86 pivots to the release position, the two slider pushers 97 separate from the slider guide 63 (FIG. 9A).

Note that this embodiment is configured so that the slider pushers 97 push the slider guide 63 to retract the retractable slider 44 to the retracted position, but the position pushed by the slider pushers 97 is not so limited. For example, an engaging part that engages the slider stop 66 and retracts the retractable slider 44 to the retracted position when the movable-side presser lever 86 rotates to the pressure position, and disengages from the presser lever stop 96 when the movable-side presser lever 86 rotates to the release position, may be formed to the inside protrusion 93 at a different circumferential position than the presser lever stop 96. As in this embodiment, the slider pushers 97 can obviously push directly against the slider guide 63 to accurately retract the slider guide 63 of the retractable slider 44.

Armholes 98 through which the sheet presser parts 99 (described below) of the sheet presser arms 89 protrude from inside the case are formed at the front and back ends of the distal ends (bottom) of the pressure lever connector 91.

The sheet presser arms 89 are supported rotatably inside the front and back inside ends of the pressure lever connector 91, and the sheet presser parts 99 (presser parts) are formed at the front and back outside ends. The sheet presser parts 99 are formed with a gentle curve on the bottom. An arm spring 100 (compression spring) that urges the sheet presser parts 99 in the direction in which the sheet presser parts 99 protrude from the armholes 98 is housed inside the pressure lever connector 91. As a result, the sheet presser arms 89 elastically press down against the left edge of the die-cut label paper P with the bottom surfaces of the sheet presser parts 99 protruding from the arm holes 98 in contact with the left edge part of the die-cut label paper P. The left edge of the die-cut label paper P can therefore be pressed with pressure desirably balanced between the front and back sheet presser parts 99.

The sheet presser arms 89 also preferably push near the left edge in order to effectively prevent creasing (buckling) the left edge of the die-cut label paper P. For example, pressure length L2 (the distance from the slider guide 63 to where pressure is applied by the sheet presser arm 89) is preferably 1-13 mm. Note that the sheet presser arms 89 may be configured to press the left edge part of the die-cut label paper P to the pressure-bearing base unit 62 (inclined surface 62*a*).

The lever spring 87 is a tension spring, the top end held by the top lever spring catch 95 of the movable-side presser lever 86, and the bottom end caught on the lever spring bottom catch 59 of the presser lever support 46. Each lever spring 87 functions as a so-called bi-stable spring. As a result, the movable-side presser lever 86 is urged to the pressure position or the released position by the lever springs 87 from a neutral point between the pressure position and the released position (a position where the lever springs 87 are upright).

The spring force of the lever spring 87 is set appropriately to the force required to rotate the movable-side presser lever 86 and the pressure of the movable-side presser lever 86 on the die-cut label paper P. More specifically, the pressure on the die-cut label paper P from the movable-side presser lever 86 is sufficient to effectively prevent crumpling the left edge of the die-cut label paper P, and not enough to interfere with conveying the die-cut label paper P.

As shown in FIG. 4 and FIG. 5, the stationary part 27 includes a stationary guide 136 fastened to the right side of the feed plate 25, and a stationary side edge presser mechanism 138 disposed to the stationary guide 136 to push against the right edge part of the die-cut label paper P.

The stationary guide 136 includes a block part 141 with a guide surface that contacts the right side edge of the die-cut label paper P, and a stationary-side pressure bearing member 143 extending to the left from the bottom of the guide surface of the block part 141. Side presser members 142 configured identically to the side presser member 42 of the movable guide 36 are respectively attached to the front and back ends of the block part 141.

Presser lever supports 146 configured identically to the presser lever supports 46 of the movable guide 36 are respectively formed on the front and back ends of the block part 141. The stationary-side presser lever 186 of the stationary side edge presser mechanism 138, which is configured identically to the movable-side presser lever 86 of the movable-side presser mechanism 38, is pivotably supported by the presser lever supports 146. The stationary-side presser lever 186 is also urged to the pressure position and the released position by a lever spring 187 in the same way as the movable-side presser lever 86.

The stationary-side pressure bearing member 143 is a basically rectangular plate that is long on the longitudinal axis. Like the movable-side pressure bearing member 43, the stationary-side pressure bearing member 143 has a pressure-bearing end 161 at the distal end with a top (flat surface 161*a*) that is substantially flush with the top of the feed plate 25, and a pressure-bearing base unit 162 at the base end with an inclined surface 162*a* that rises from the flat surface 161*a* toward the base.

Operation of parts of the guide unit 21 thus comprised is further described below in the operation whereby the user sets die-cut label paper P to the feed plate 25, and the subsequent die-cut label paper P conveyance process.

To set the die-cut label paper P onto the feed plate 25, the user first opens the access cover 17 and rotates the stationary-side presser lever 186 from the pressure position to the released position. To do this, the user rotates the stationary-side presser lever 186 in resistance to the lever spring 187 from the pressure position to the neutral point. When the neutral point is passed, the urging direction changes and the stationary-side presser lever 186 can be rotated to the released position without resistance from the lever spring 187. The stationary-side presser lever 186 is then held in the released position by the urging force of the lever spring 187.

Substantially simultaneously to rotating the stationary-side presser lever 186 to the released position, the user rotates the movable-side presser lever 86 from the pressure position to the released position. In this operation the user first rotates the movable-side presser lever 86 in resistance to the lever spring 87 from the pressure position to the neutral point, the urging direction of the lever spring 87 changes when the neutral point is passed, and the movable-side presser lever 86 can then be rotated to the released position without resistance from the lever spring 87.

When the movable-side presser lever 86 rotates to the released position, the presser lever stop 96 of the movable-side presser lever 86 engages the slider stop 66 and the retractable slider 44 is pushed to the advanced position. At this time the lever spring 87 urges the retractable slider 44 to the advanced position through the movable-side presser lever 86. More specifically, the movable-side presser lever 86 is held in the released position and the retractable slider 44 is held in the advanced position by the urging force of the lever spring 87 (FIG. 9A). The user then sets the die-cut label paper P on the feed plate 25 while the stationary-side presser lever 186 and the movable-side presser lever 86 are held in their respective released positions.

Next, the user rotates the lock release lever 75 from the unreleased position to the release position. As a result, the lock plate 72 pivots from the locked position through the neutral position to the unlocked position (FIGS. 10A-10C). When the lock plate 72 is in the unlocked position, both the friction member 77 and the lock pin 71 separate from the guide shaft 35, and the movable part 26 can be slid smoothly on the transverse axis without producing friction (sliding resistance) between the friction member 77 and lock pin 71 and the guide shaft 35.

The user can slide the movable guide 36 on the transverse axis and adjust the guide width until the slider guide 63 of the retractable slider 44 contacts the left edge of the die-cut label paper P.

Note that a configuration that makes rotating the lock release lever 75 to the release position difficult for the user when the movable-side presser lever 86 is in the pressure position is preferable. For example, the movable-side presser lever 86 could be shaped to prevent accessing the lock release lever 75 when the movable-side presser lever 86 is in the pressure position. As a result, the user can be prevented from sliding the movable guide 36 when the movable-side presser lever 86 is pressing against the die-cut label paper P.

When the user releases the lock release lever 75 after adjusting the guide width, the lock release lever 75 pivots to the unreleased position due to the urging force of the lock spring 74, and the lock plate 72 pivots from the unlocked position through the neutral position to the locked position (FIGS. 10A-10C). When the lock plate 72 is rotated to the locked position, the friction member 77 is urged rotationally by the lock spring 74 to the guide shaft 35 using the lock pin 71 as a fulcrum, and the lock pin 71 is urged rotationally by the lock spring 74 to the guide shaft 35 using the friction member 77 as a fulcrum. As a result, both the friction member 77 and lock pin 71 contact the guide shaft 35 firmly, producing friction between the friction member 77 and guide shaft 35 and between the lock pin 71 and guide shaft 35. Friction between the lock plate 72 and the guide shaft 35 can therefore be increased without using a lock spring 74 with a strong urging force. The movable guide 36 can therefore be clamped firmly when locked without impeding unlocking the movable guide 36, that is, without requiring a strong operating force to rotate the lock release lever 75 to the unreleased position in resistance to the lock spring 74.

When rotated to the locked position, the lock plate 72 is electrically connected to the guide shaft 35 through the metal (conductive) lock pin 71, and is grounded through the guide shaft 35. As a result, the lock plate 72 can be prevented from being ungrounded and electrically charged even if a dielectric (such as rubber) material is used for the friction member 77. Adversely affecting nearby sensors (such as the variable resistor described above) as a result of the lock plate 72 being charged can therefore be prevented.

When the movable guide 36 is locked to the guide shaft 35 by the lock mechanism 37, the user rotates the stationary-side presser lever 186 from the released position to the pressure position. At this time the user rotates the stationary-side presser lever 186 in resistance to the lever spring 187 from the released position to the neutral point, the urging direction then changes when the neutral point is past, and the stationary-side presser lever 186 can be rotated to the pressure position without resistance from the lever spring 187. When pivoted to the pressure position, the stationary-side presser lever 186 presses the right side of the die-cut label paper P to the stationary-side pressure bearing member 143 due to the urging force of the lever spring 187.

Note that rotating the stationary-side presser lever 186 from the released position to the pressure position may be done before sliding the movable guide 36 after setting the die-cut label paper P on the feed plate 25.

The user rotates the movable-side presser lever 86 from the released position to the pressure position substantially simultaneously to rotating the stationary-side presser lever 186 to the pressure position. In this event, the user rotates the movable-side presser lever 86 in resistance to the lever spring 87 from the released position to the neutral point, the urging direction then changes when the neutral point is past, and the movable-side presser lever 86 can be rotated to the pressure position without resistance from the lever spring 87. When pivoted to the pressure position, the movable-side presser lever 86 presses the left side of the die-cut label paper P to the movable-side pressure bearing member 43 by the urging force of the lever spring 87.

When the movable-side presser lever 86 rotates to the pressure position, the presser lever stop 96 of the movable-side presser lever 86 disengages from the slider stop 66. As a result, the retractable slider 44 is no longer held in the advanced position by the lever spring 87 through the movable-side presser lever 86. When the urging force is thus released, the slider pushers 97 of the movable-side presser lever 86 pivoted to the pressure position push against the slider guide 63 of the retractable slider 44, and the retractable slider 44 retracts to the retracted position (FIGS. 9A-9B). This increases the guide width slightly compared with the adjusted guide width, and enables desirably conveying the die-cut label paper P without applying excessive feed resistance to the die-cut label paper P.

As described above, the retractable slider 44 advances to an advanced position and is held in the advanced position in conjunction with the movable-side presser lever 86 rotating to the released position, and the retractable slider 44 retracts to the retracted position in conjunction with the movable-side presser lever 86 rotating to the pressure position, by means of an interlocking mechanism including the presser lever stop 96, slider pushers 97, and lever spring 87. Because the retractable slider 44 advances and retracts in conjunction with rotation of the movable-side presser lever 86, the user does not need to perform separate actions to rotate the movable-side presser lever 86 and advance or retract the retractable slider 44, and operability can be improved.

The user closes the access cover 17 after setting the die-cut label paper P as described above. The printer 10 starts the die-cut label paper P conveyance process when a print command is received from the data processing terminal. Because the pressure-bearing base units 62, 162 (inclined surfaces 62*a*, 162*a*) cause the sides of the die-cut label paper P conveyed over the feed plate 25 to slope, the side can be prevented from folding and buckling up to the coated side la (printed side) (FIGS. 9A and 9B). Because incisions 3 are formed in the coated side la of the die-cut label paper P as described above, the die-cut label paper P can easily buckle convexly to the coated side la at the position where an incision 3 is formed. However, because the edge part of the die-cut label paper P including where the incisions 3 are formed slopes up in the printer 10, the die-cut label paper P can be prevented from buckling convexly to the coated side la at the incisions 3.

Furthermore, because the area around the inclined edge area is held down by the sheet presser parts 99, 199, the sides of the die-cut label paper P are also prevented from lifting away from the flat surfaces 61*a*, 161*a* of the pressure-bearing ends 61, 161. The sides of the die-cut label paper P are also prevented from lifting away from the flat surfaces 61*a*, 161*a* of the pressure-bearing ends 61, 161 by the stops 42*a*, 142*a* pressing against the sides of the die-cut label paper P (FIGS. 9A and 9B). Wrinkling (buckling) the sides as a result of the sides lifting up can therefore be prevented.

Folding the sides of the die-cut label paper P can also be prevented, and the edges of the die-cut label paper P conveyed over the top of the feed plate 25 can be guided, by using a crumpling prevention unit including the inclined surfaces 62*a*, 162*a*, sheet presser parts 99, 199, and stops 42*a*, 142*a*.

Because a crumpling prevention unit (inclined surface 62*a*, sheet presser part 99, and stop 42*a*) is disposed to both the front and back ends of the movable part 26, wrinkling the left side of the die-cut label paper P can be effectively prevented at the front and back ends of the movable guide 36 against which skewed die-cut label paper P is pushed firmly. Because the crumpling prevention unit is also disposed to the stationary part 27, wrinkling the sides of the die-cut label paper P can be prevented whether the die-cut label paper P skews to the right or left.

As described above, by having lever springs 87, 187 that respectively urge a movable-side pressure lever 86 and a stationary-side pressure lever 186 to a pressure position and a released position from a neutral point, the printer 10 according to this embodiment can reliably rotate the movable-side pressure lever 86 and stationary-side pressure lever 186 that hold the die-cut label paper P to the pressure position and the released position. Operability when setting the die-cut label paper P for printing to the feed plate 25 can therefore be improved.

Furthermore, when the lock plate 72 has rotated to the lock position, the friction member 77 is urged to pivot on the lock pin 71 and rotate to the guide shaft 35 by the lock spring 74, the lock pin 71 is urged by the lock spring 74 to rotate to the guide shaft 35 pivoting on the friction member 77 by the lock spring 74, and the movable guide 36 can be held firmly in the locked position without impairing operability when unlocking the movable guide 36. Conveyed die-cut label paper P can therefore be guided reliably without the movable guide 36 moving on the transverse axis after being locked.

Furthermore, because the movable part 26 and stationary part 27 each have a crumpling prevention unit including inclined surfaces 62*a*, 162*a*, sheet presser parts 99, 199, and stops 42*a*, 142*a*, creasing the side edge of the die-cut label paper P can be prevented while guiding the side of the die-cut label paper P conveyed over the top of the feed plate 25. The die-cut label paper P that is guided by the sides and protected from the sides wrinkling can be printed by the print unit 23 disposed downstream in the conveyance direction from the guide unit 21.

Note that continuous label paper Q such as shown in FIGS. 1A and 1B may also be used as the print medium. Such continuous label paper Q has a continuous liner 1 and a single continuous label 4 affixed to the coated side la of the liner 1. This continuous label paper Q is made by stripping the waste after forming a continuous incision 3 only at a specific distance (margin D) from the side edge in a die-cutting process. This continuous label paper Q also folds easily to the coated side la as indicated by the arrow in FIG. 1B where the incision 3 is formed, but the side area can be prevented from folding to the coated side la as a result of the pressure-bearing base units 62, 162 (inclined surfaces 62*a*, 162*a*) in the printer 10 causing the side of the die-cut label paper P to slope when conveyed over the feed plate 25.

The print medium is also not limited to media formed with an incision 3 as described in the die-cut label paper P and continuous label paper Q above, and may be plain roll paper, fanfold paper, or other type of continuous sheet media, or cut-sheet media. The printer 10 can also prevent wrinkling the side of such sheet media while guiding the sides of the sheet media conveyed over the feed plate 25.

The invention claimed is:

1. A sheet guide device comprising:

a crumpling prevention unit having a guide unit with a guide surface that guides a side portion of a sheet member conveyed in a conveyance direction over a conveyance path surface and prevents crumpling the side portion of the sheet member that contacts the guide surface, the crumpling prevention unit including a protruding part disposed protruding from the conveyance path surface and causing the side portion of the passing sheet member to rise to the side, a pressure part configured to press the sheet member to the conveyance path surface at the same or adjacent position of the protruding part, in a direction that is perpendicular to the conveyance direction and that is parallel to the conveyance path surface, and a stop configured to contact the side portion of the sheet member inclined by the protruding part.

2. The sheet guide device described in claim 1, wherein:

the protruding part has an inclined surface formed to rise from the conveyance path surface to the outside on the transverse axis perpendicular to the conveyance direction; and a contact surface of the stop is at an acute angle to the inclined surface.

3. The sheet guide device described in claim 1, wherein:

the guide unit has a first guide that guides one side portion of the sheet member, and a second guide that guides the other side portion of the sheet member; and the crumpling prevention unit is disposed to both the first guide and the second guide.

4. The sheet guide device described in claim 3, wherein:

one of the first guide and the second guide is a stationary guide.

5. The sheet guide device described in claim 1, wherein:

the crumpling prevention unit is disposed at both the upstream end and the downstream end of the guide unit in the conveyance direction.

6. The sheet guide device described in claim 1, wherein:

the sheet member is die-cut label paper including a die-cut continuous label affixed to a liner, the sheet member includes incisions formed in the liner at a position a specific distance from the side portion of the liner, and the sheet member is configured to be conveyed with an opposite side of the liner as a side to which the label is affixed against the conveyance path surface; and the protruding part is configured to incline the side portion of the sheet member including the position where the incision is made.

7. A printing device comprising:

the sheet guide device described in claim 1;

a conveyance unit that conveys the sheet member; and a print unit that prints on the sheet member downstream in the conveyance direction from the sheet guide device.

* * * * *